US011811124B2

(12) United States Patent
Wiegner et al.

(10) Patent No.: US 11,811,124 B2
(45) Date of Patent: Nov. 7, 2023

(54) CONTROLLABLE RADIO FREQUENCY SWITCHING AND/OR SPLITTING DEVICE

(71) Applicant: Nokia Technologies Oy, Espoo (FI)

(72) Inventors: Dirk Wiegner, Schwaikheim (DE); Wolfgang Tempi, Sersheim (DE); Senad Bulja, Dublin (IE); Rose Kopf, Green Brook, NJ (US)

(73) Assignee: Nokia Technologies Oy, Espoo (FI)

( * ) Notice: Subject to any disclaimer, the term of this patent is extended or adjusted under 35 U.S.C. 154(b) by 0 days.

(21) Appl. No.: 17/507,045

(22) Filed: Oct. 21, 2021

(65) Prior Publication Data

US 2022/0131251 A1 Apr. 28, 2022

(30) Foreign Application Priority Data

Oct. 22, 2020 (FI) ..... 20206043

(51) Int. Cl.
*H01P 3/12* (2006.01)
*H01P 3/16* (2006.01)
*H01P 5/12* (2006.01)

(52) U.S. Cl.
CPC ..... *H01P 3/12* (2013.01); *H01P 3/16* (2013.01); *H01P 5/12* (2013.01)

(58) Field of Classification Search
CPC ..... H01P 3/12; H01P 3/16; H01P 5/12; H01P 1/10; H01P 5/16; H01P 3/165; H01P 5/04
See application file for complete search history.

(56) References Cited

U.S. PATENT DOCUMENTS

| | | | |
|---|---|---|---|
| 8,849,071 | B2 | 9/2014 | Kissa et al. |
| 9,065,163 | B1 | 6/2015 | Wu et al. |
| 9,666,927 | B1 | 5/2017 | Massman |
| 10,033,080 | B2 | 7/2018 | Bulja et al. |
| 10,187,107 | B1 | 1/2019 | Bulja et al. |
| 2002/0054727 | A1 | 5/2002 | Song |

(Continued)

FOREIGN PATENT DOCUMENTS

| | | |
|---|---|---|
| EP | 3 128 612 A1 | 2/2017 |
| EP | 3319165 A1 | 5/2018 |

(Continued)

OTHER PUBLICATIONS

Jost, M. et al. Fully dielectric interference-based SPDT with liquid crystal phase shifters. In: IET Microwaves, Antennas & Propagation. The Institution of Engineering and Technology, Nov. 24, 2017, vol. 12, No. 6, pp. 850-857.

(Continued)

*Primary Examiner* — Andrea Lindgrem Baltzell
*Assistant Examiner* — Kimberly E Glenn
(74) *Attorney, Agent, or Firm* — Lippes Mathias LLP

(57) ABSTRACT

An apparatus that is a voltage-controlled splitting and/or switching apparatus comprising a waveguide for a radio frequency signal comprising at least one input and at least two outputs, wherein the waveguide is a cavity waveguide or a polymer microwave fiber waveguide, and the waveguide comprises at least a first branch and a second branch, at least one element comprising voltage reactive material in between electrodes and extending, at least partly, across at least one of the first branch and the second branch, and a voltage control caused to apply voltage to the at least one element.

13 Claims, 15 Drawing Sheets

(56) References Cited

U.S. PATENT DOCUMENTS

| | | | | |
|---|---|---|---|---|
| 2002/0076142 | A1* | 6/2002 | Song | H04Q 11/0066 385/16 |
| 2019/0346730 | A1 | 11/2019 | Bulja et al. | |
| 2021/0025030 | A1 | 1/2021 | Lawrence et al. | |
| 2021/0075079 | A1 | 3/2021 | Wiegner et al. | |
| 2021/0124231 | A1 | 4/2021 | Wiegner et al. | |
| 2021/0306020 | A1 | 9/2021 | Bulia et al. | |

FOREIGN PATENT DOCUMENTS

| | | | |
|---|---|---|---|
| EP | 3 618 117 | A1 | 3/2020 |
| EP | 3 772 773 | A1 | 2/2021 |
| EP | 3 787 116 | A1 | 3/2021 |
| EP | 3879623 | A1 * | 9/2021 |
| EP | 3 893 326 | A1 | 10/2021 |
| WO | WO 2021/244857 | A1 | 12/2021 |

OTHER PUBLICATIONS

Reese, R. et al. Liquid crystal based dielectric waveguide phase shifters for phased arrays at W-band. In: IEEE Access. IEEE, Sep. 18, 2019, vol. 7, pp. 127032-127041.

Jost, M. et al. Comparison of hollow waveguide and dielectric fibre based SPDT switches for W-band. In: 2016 German Microwave Conference (GeMiC). IEEE, Mar. 14, 2016, pp. 140-143.

Polat, E. et al. Liquid crystal phase shifter based on nonradiative dielectric waveguide topology at Wband. In: 2019 IEEE MTT-S International Microwave Symposium. IEEE, May 7, 2019, pp. 184-187.

Nickel, M. et al. Liquid crystal based tunable reflection-type power divider. In: 2018 48th European Microwave Conference. IEEE, Sep. 23, 2018, pp. 45-48.

De Wit, M. et al. Polymer microwave fibers. In: IEEE Microwave Magazine. IEEE, Jan. 2020, vol. 21, No. 1, pp. 51-66.

Jost M. et al: "Interference based W-band single-pole double-throw with tunable liquid crystal based waveguide phase shifters", 2017 IEEE MTT-S IMS Jun. 4, 2017, pp. 184-187, DOI: 10.1109/MWSYM.2017.8059003.

Polat Ersin et al: "Fully Dielectric Phased Array for Beamsteering Using Liquid Crystal Technology at W-Band", 2020 14$^{th}$ EUCAP, Mar. 15, 2020, pp. 1-5, DOI: 10.23919/EUCAP48036.2020.9135584.

Anagnostou Dimitris E et al: "Vanadium Dioxide for Reconfigurable Antennas and Microwave Devices: Enabling RF Reconfigurability Through Smart Materials", IEEE Antennas and Propagation Magazine, Feb. 27, 2020, pp. 58-73, DOI: 10.1109/MAP.2020.2964521.

Donisi et al., "A Switchable Liquid-Crystal Optical Channel Waveguide on Silicon", IEEE Journal of Quantum Electronics, V. 46, Issue 5, May 2010, Publication Mar. 1, 2010 DOI: 10.1109/JQE.2009.2038241.

* cited by examiner

CONTROLLABLE RADIO FREQUENCY SWITCHING AND/OR SPLITTING DEVICE

The present application claims the benefit of priority of Finnish Patent Application No. 20206043, filed Oct. 22, 2020.

FIELD

The following exemplary embodiments relate to radio frequency front end components and flexible usage of analogue radio frequency components as efficiently as possible.

BACKGROUND

In mobile communication, for example, in different mobile radio standards such as 2G, 3G, 4G and 5G, a variety of frequency bands, with different bandwidths, are utilized. Further, applications such as Internet of things, IoT, vehicle to all, V2X and industry 4.0, are emerging and there is increasing demand for high data rate content such as 4K videos, etc. To cope with this situation, appropriate solutions capable of handling the variety of frequency bands and standards as well as handling the high data rates are required. Exploiting higher frequency ranges such as mm-wave or even THz-range providing an increased bandwidth, as well as concepts like multi-antenna systems are promising approaches to meet these challenges. Yet, these approaches need flexible and tunable RF frontends, to exploit their full potential.

BRIEF DESCRIPTION

The scope of protection sought for various embodiments of the invention is set out by the independent claims. The exemplary embodiments and features, if any, described in this specification that do not fall under the scope of the independent claims are to be interpreted as examples useful for understanding various embodiments of the invention.

According to a first aspect there is provided a method comprising providing a radio frequency signal to at least one input of a waveguide for a radio frequency signal, that is comprised in a voltage-controlled splitting and/or switching apparatus, and wherein the waveguide comprises the at least one input and at least two outputs, wherein the waveguide is a cavity waveguide or a polymer microwave fiber waveguide and comprises at least a first branch and a second branch, the apparatus further comprising at least one element comprising voltage reactive material in between electrodes and extending, at least partly, across at least the first branch and the second branch, the apparatus further comprising a voltage control, and causing at least one voltage control to apply voltage to the at least one element.

In an exemplary embodiment according to the first aspect, the voltage is applied such that the radio frequency signal is switched and/or power divided by the waveguide.

In another exemplary embodiment according to the first aspect, the voltage applied by the voltage control is applied according to information retrieved from a look-up table.

In another exemplary embodiment according to the first aspect, the voltage is applied to sub-skin depth electrodes.

In another exemplary embodiment according to the first aspect, the waveguide comprises a plurality of elements and the method further comprises applying voltage control separately to the plurality of elements.

In another exemplary embodiment according to the first aspect, the waveguide comprises a plurality of inputs and the method further comprises providing a plurality of radio frequency signals to the plurality of inputs respectively.

In another exemplary embodiment according to the first aspect, the voltage reactive material is one of the following: liquid crystal, transition metal oxide or electrochromic material.

In another exemplary embodiment according to the first aspect, the at least one element is located at an input part of the at least one of the first and the second branch or at an end of at least one of the first branch and the second branch.

In another exemplary embodiment according to the first aspect, the at least one element comprises a plurality of layers of the voltage reactive material.

In another exemplary embodiment according to the first aspect, the at least one element is coupled to another element at the dividing part and wherein the other element comprises at least one of electrochromic material, liquid crystal and/or transition metal oxide, as the voltage reactive material.

In another exemplary embodiment according to the first aspect, the apparatus is a voltage-controlled radio frequency splitting and/or switching device or the apparatus is a voltage-controlled power splitting and/or switching device.

In another exemplary embodiment according to the first aspect, the apparatus is transmission-type or reflective-type.

According to a second aspect there is an apparatus that is a voltage-controlled power and/or frequency splitting and/or switching apparatus comprising a waveguide for a radio frequency signal comprising at least one input and at least two outputs, wherein the waveguide is a cavity waveguide or a polymer microwave fiber waveguide, and the waveguide comprises at least a first branch and a second branch, at least one element comprising voltage reactive material in between electrodes and extending, at least partly, across the at least one of the first branch and the second branch, and a voltage control caused to apply voltage to the at least one element.

In an exemplary embodiment according to the second aspect, the at least one element is located at an input part of the at least one of the first branch and the second branch or at an end of at least one of the first branch and the second branch.

In another exemplary embodiment according to the second aspect, the voltage reactive material is one of the following: liquid crystal, transition metal oxide or electrochromic material.

In another exemplary embodiment according to the second aspect, the at least one element is a wall extending, at least partly, across the cross-section of the respective branch or a ring extending around the respective branch.

In another exemplary embodiment according to the second aspect, the at least one element comprises a plurality of layers of the voltage reactive material.

In another exemplary embodiment according to the second aspect, the at least one element is coupled to another element at the dividing part and wherein the other element comprises at least one of electrochromic material, liquid crystal and/or transition metal oxide, as the voltage reactive material.

In another exemplary embodiment according to the second aspect, the apparatus is a voltage-controlled radio frequency splitting and/or switching device or the apparatus is a voltage-controlled power splitting and/or switching device.

In another exemplary embodiment according to the second aspect, the apparatus is transmission-type or reflective-type.

According to another aspect there is provided a computer program product readable by a computer and, when executed by the computer, configured to cause the computer to execute a computer process comprising providing a radio frequency signal to at least one input of a waveguide for a radio frequency signal, that is comprised in a voltage-controlled splitting and/or switching apparatus, and wherein the waveguide comprises the at least one input and at least two outputs, wherein the waveguide is a cavity waveguide or a polymer microwave fiber waveguide and comprises at least a first branch and a second branch, the apparatus further comprising at least one element comprising voltage reactive material in between electrodes and extending, at least partly, across at least one of the first branch and the second branch and the apparatus further comprising a voltage control, and causing at least one voltage control to apply voltage to the at least one element.

According to another aspect there is provided a computer program comprising instructions for causing an apparatus to perform at least the following: providing a radio frequency signal to at least one input of a waveguide for a radio frequency signal, that is comprised in a voltage-controlled splitting and/or switching apparatus, and wherein the waveguide comprises the at least one input and at least two outputs, wherein the waveguide is a cavity waveguide or a polymer microwave fiber waveguide and comprises at least a first branch and a second branch, the apparatus further comprising at least one element comprising voltage reactive material in between electrodes and extending, at least partly, across at least one of the first branch and the second branch and the apparatus further comprising a voltage control, and causing at least one voltage control to apply voltage to the at least one element.

According to another aspect there is provided a non-transitory computer readable medium comprising program instructions for causing an apparatus to perform at least the following: providing a radio frequency signal to at least one input of a waveguide for a radio frequency signal, that is comprised in a voltage-controlled splitting and/or switching apparatus, and wherein the waveguide comprises the at least one input and at least two outputs, wherein the waveguide is a cavity waveguide or a polymer microwave fiber waveguide and comprises at least a first branch and a second branch, the apparatus further comprising at least one element comprising voltage reactive material in between electrodes and extending, at least partly, across at least one of the first branch and the second branch and the apparatus further comprising a voltage control, and causing at least one voltage control to apply voltage to the at least one element.

LIST OF DRAWINGS

In the following, the invention will be described in greater detail with reference to the embodiments and the accompanying drawings, in which.

DESCRIPTION OF EMBODIMENTS

Figure 1:
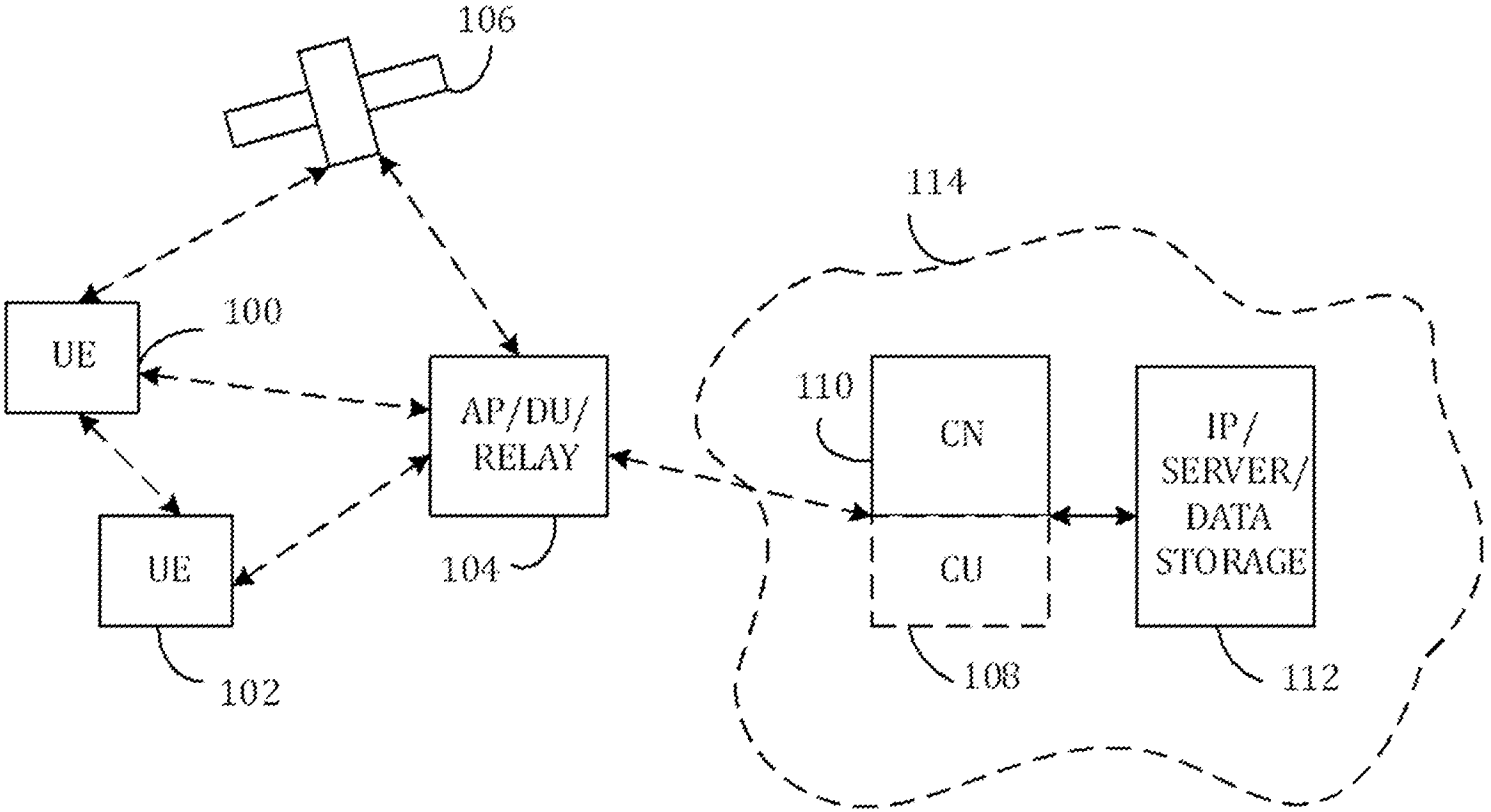
FIG. 1 illustrates an exemplary embodiment of a radio access network.

The following embodiments are exemplifying. Although the specification may refer to "an", "one", or "some" embodiment(s) in several locations of the text, this does not necessarily mean that each reference is made to the same embodiment(s), or that a particular feature only applies to a single embodiment. Single features of different embodiments may also be combined to provide other embodiments.

As used in this application, the term 'circuitry' refers to all of the following: (a) hardware-only circuit implementations, such as implementations in only analog and/or digital circuitry, and (b) combinations of circuits and software (and/or firmware), such as (as applicable): (i) a combination of processor(s) or (ii) portions of processor(s)/software including digital signal processor(s), software, and memory(ies) that work together to cause an apparatus to perform various functions, and (c) circuits, such as a microprocessor(s) or a portion of a microprocessor(s), that require software or firmware for operation, even if the software or firmware is not physically present. This definition of 'circuitry' applies to all uses of this term in this application. As a further example, as used in this application, the term 'circuitry' would also cover an implementation of merely a processor (or multiple processors) or a portion of a processor and its (or their) accompanying software and/or firmware. The term 'circuitry' would also cover, for example and if applicable to the particular element, a baseband integrated circuit or applications processor integrated circuit for a mobile phone or a similar integrated circuit in a server, a cellular network device, or another network device. The above-described embodiments of the circuitry may also be considered as embodiments that provide means for carrying out the embodiments of the methods or processes described in this document.

The techniques and methods described herein may be implemented by various means. For example, these techniques may be implemented in hardware (one or more devices), firmware (one or more devices), software (one or more modules), or combinations thereof. For a hardware implementation, the apparatus(es) of embodiments may be implemented within one or more application-specific integrated circuits (ASICs), digital signal processors (DSPs), digital signal processing devices (DSPDs), programmable logic devices (PLDs), field programmable gate arrays (FPGAs), graphics processing units (GPUs), processors, controllers, micro-controllers, microprocessors, other electronic units designed to perform the functions described herein, or a combination thereof. For firmware or software, the implementation can be carried out through modules of at least one chipset (e.g. procedures, functions, and so on) that perform the functions described herein. The software codes may be stored in a memory unit and executed by processors. The memory unit may be implemented within the processor or externally to the processor. In the latter case, it can be communicatively coupled to the processor via any suitable means. Additionally, the components of the systems described herein may be rearranged and/or complemented by additional components in order to facilitate the achievements of the various aspects, etc., described with regard thereto, and they are not limited to the precise configurations set forth in the given figures, as will be appreciated by one skilled in the art.

Embodiments described herein may be implemented in a communication system, such as in at least one of the following: Global System for Mobile Communications (GSM) or any other second generation cellular communication system, Universal Mobile Telecommunication System (UMTS, 3G) based on basic wideband-code division multiple access (W-CDMA), high-speed packet access (HSPA), Long Term Evolution (LTE), LTE-Advanced, a system based on IEEE 802.11 specifications, a system based on IEEE 802.15 specifications, and/or a fifth generation (5G) mobile or cellular communication system. The embodiments are not, however, restricted to the system given as an example but a person skilled in the art may apply the solution to other communication systems provided with necessary properties.

FIG. 1 depicts examples of simplified system architectures showing some elements and functional entities, all being logical units, whose implementation may differ from what is shown. The connections shown in FIG. 1 are logical connections; the actual physical connections may be different. It is apparent to a person skilled in the art that the system may comprise also other functions and structures than those shown in FIG. 1. The example of FIG. 1 shows a part of an exemplifying radio access network.

FIG. 1 shows terminal devices 100 and 102 configured to be in a wireless connection on one or more communication channels in a cell with an access node (such as (e/g)NodeB) 104 providing the cell. The access node 104 may also be referred to as a node. The physical link from a terminal device to a (e/g)NodeB is called uplink or reverse link and the physical link from the (e/g)NodeB to the terminal device is called downlink or forward link. It should be appreciated that (e/g)NodeBs or their functionalities may be implemented by using any node, host, server or access point etc. entity suitable for such a usage. It is to be noted that although one cell is discussed in this exemplary embodiment, for the sake of simplicity of explanation, multiple cells may be provided by one access node in some exemplary embodiments.

A communication system may comprise more than one (e/g)NodeB in which case the (e/g)NodeBs may also be configured to communicate with one another over links, wired or wireless, designed for the purpose. These links may be used for signalling purposes. The (e/g)NodeB is a computing device configured to control the radio resources of communication system it is coupled to. The (e/g)NodeB may also be referred to as a base station, an access point or any other type of interfacing device including a relay station capable of operating in a wireless environment. The (e/g)NodeB includes or is coupled to transceivers. From the transceivers of the (e/g)NodeB, a connection is provided to an antenna unit that establishes bi-directional radio links to user devices. The antenna unit may comprise a plurality of antennas or antenna elements. The (e/g)NodeB is further connected to core network 110 (CN or next generation core NGC). Depending on the system, the counterpart on the CN side may be a serving gateway (S-GW, routing and forwarding user data packets), packet data network gateway (P-GW), for providing connectivity of terminal devices (UEs) to external packet data networks, or mobile management entity (MME), etc.

The terminal device (also called UE, user equipment, user terminal, user device, etc.) illustrates one type of an apparatus to which resources on the air interface are allocated and assigned, and thus any feature described herein with a terminal device may be implemented with a corresponding apparatus, such as a relay node. An example of such a relay node is a layer 3 relay (self-backhauling relay) towards the base station. Another example of such a relay node is a layer 2 relay. Such a relay node may contain a terminal device part and a Distributed Unit (DU) part. A CU (centralized unit) may coordinate the DU operation via F1AP-interface for example.

The terminal device may refer to a portable computing device that includes wireless mobile communication devices operating with or without a subscriber identification module (SIM), or an embedded SIM, eSIM, including, but not limited to, the following types of devices: a mobile station (mobile phone), smartphone, personal digital assistant (PDA), handset, device using a wireless modem (alarm or measurement device, etc.), laptop and/or touch screen computer, tablet, game console, notebook, and multimedia device. It should be appreciated that a user device may also be an exclusive or a nearly exclusive uplink only device, of which an example is a camera or video camera loading images or video clips to a network. A terminal device may also be a device having capability to operate in Internet of Things (IoT) network which is a scenario in which objects are provided with the ability to transfer data over a network without requiring human-to-human or human-to-computer interaction. The terminal device may also utilise cloud. In some applications, a terminal device may comprise a small portable device with radio parts (such as a watch, earphones or eyeglasses) and the computation is carried out in the cloud. The terminal device (or in some embodiments a layer 3 relay node) is configured to perform one or more of user equipment functionalities.

Various techniques described herein may also be applied to a cyber-physical system (CPS) (a system of collaborating computational elements controlling physical entities). CPS may enable the implementation and exploitation of massive amounts of interconnected ICT devices (sensors, actuators, processors microcontrollers, etc.) embedded in physical objects at different locations. Mobile cyber physical systems, in which the physical system in question has inherent mobility, are a subcategory of cyber-physical systems. Examples of mobile physical systems include mobile robotics and electronics transported by humans or animals.

Additionally, although the apparatuses have been depicted as single entities, different units, processors and/or memory units (not all shown in FIG. 1) may be implemented.

5G enables using multiple input-multiple output (MIMO) antennas, many more base stations or nodes than the LTE (a so-called small cell concept), including macro sites operating in co-operation with smaller stations and employing a variety of radio technologies depending on service needs, use cases and/or spectrum available. 5G mobile communications supports a wide range of use cases and related applications including video streaming, augmented reality, different ways of data sharing and various forms of machine type applications such as (massive) machine-type communications (mMTC), including vehicular safety, different sensors and real-time control. 5G is expected to have multiple radio interfaces, namely below 6 GHz, cmWave and mmWave, and also being integratable with existing legacy radio access technologies, such as the LTE. Integration with the LTE may be implemented, at least in the early phase, as a system, where macro coverage is provided by the LTE and 5G radio interface access comes from small cells by aggregation to the LTE. In other words, 5G is planned to support both inter-RAT operability (such as LTE-5G) and inter-RI operability (inter-radio interface operability, such as below 6 GHz-cmWave, below 6 GHz-cmWave-mmWave). One of the concepts considered to be used in 5G networks is network slicing in which multiple independent and dedicated virtual sub-networks (network instances) may be created within the same infrastructure to run services that have different requirements on latency, reliability, throughput and mobility.

An exemplary architecture in LTE networks is fully distributed in the radio and fully centralized in the core network. The low latency applications and services in 5G may require to bring the content close to the radio which may lead to local break out and multi-access edge computing (MEC). 5G enables analytics and knowledge generation to occur at the source of the data. This approach requires leveraging resources that may not be continuously connected to a network such as laptops, smartphones, tablets and sensors. MEC provides a distributed computing environment for application and service hosting. It also has the ability to store and process content in close proximity to cellular subscribers for faster response time. Edge computing covers a wide range of technologies such as wireless sensor networks, mobile data acquisition, mobile signature analysis, cooperative distributed peer-to-peer ad hoc networking and processing also classifiable as local cloud/fog computing and grid/mesh computing, dew computing, mobile edge computing, cloudlet, distributed data storage and retrieval, autonomic self-healing networks, remote cloud services, augmented and virtual reality, data caching, Internet of Things (massive connectivity and/or latency critical), critical communications (autonomous vehicles, traffic safety, real-time analytics, time-critical control, healthcare applications).

The communication system is also able to communicate with other networks, such as a public switched telephone network or the Internet 112, and/or utilise services provided by them. The communication network may also be able to support the usage of cloud services, for example at least part of core network operations may be carried out as a cloud service (this is depicted in FIG. 1 by "cloud" 114). The communication system may also comprise a central control entity, or a like, providing facilities for networks of different operators to cooperate for example in spectrum sharing.

Edge cloud may be brought into radio access network (RAN) by utilizing network function virtualization (NFV) and software defined networking (SDN). Using edge cloud may mean access node operations to be carried out, at least partly, in a server, host or node operationally coupled to a remote radio head or base station comprising radio parts. It is also possible that node operations will be distributed among a plurality of servers, nodes or hosts. Application of cloudRAN architecture enables RAN real time functions being carried out at the RAN side (in a distributed unit, DU 104) and non-real time functions being carried out in a centralized manner (in a centralized unit, CU 108).

It should also be understood that the distribution of labour between core network operations and base station operations may differ from that of the LTE or even be non-existent. Some other technology that may be used includes for example Big Data and all-IP, which may change the way networks are being constructed and managed. 5G (or new radio, NR) networks are being designed to support multiple hierarchies, where MEC servers can be placed between the core and the base station or nodeB (gNB). It should be appreciated that MEC can be applied in 4G networks as well.

While digital mobile radio frontend units may be reconfigurable when using components such as field-programmable arrays, FPGAs, analogue radio frequency, RF, frontends may be limited in terms of flexibility and/or tunability of the used RF devices with respect to, for example, frequency, bandwidth and RF signal/RF power distribution. Thus, it would be beneficial to have flexible and tuneable circuits RF devices and circuits that are applicable to different frequency ranges, from sub 6 GHz via mm-wave and optionally also up to THz frequencies. Such devices and circuits may enable flexible multi-antenna systems such as beamforming or massive MIMO, flexible signal/power distribution systems and/or filter applications as well as bus systems for e.g. automotive or data center applications. That would also bring an additional benefit of reduced cost due to diminished need for application specific designs/systems and increase sustainability.

Waveguide technologies, such as polymer microwave fibers, PMF, or cavity-based waveguides may be used for transmitting and or guiding the RF signals and related RF power. Voltage reactive materials, such as electrochromic, EC, liquid crystal, LC or transition metal oxide, TMO, are material that provide an inherent voltage-controlled impact on RF performance. By combining waveguide technologies and voltage reactive materials in switch-based RF configurations, RF tuneable waveguide solutions may be obtained that enable flexible controlling of RF performance for example with respect to power switching, power splitting and/or distribution. Thus, a voltage-controlled splitting and/or switching device may be obtained. These types of flexible RF splitting and/or switching devices may be beneficial for, at least, multi-antenna, such as beamforming and mMIMO systems, as well as mm-wave and THz applications and bus systems in for example in automotive or data center applications.

Figure 2A:
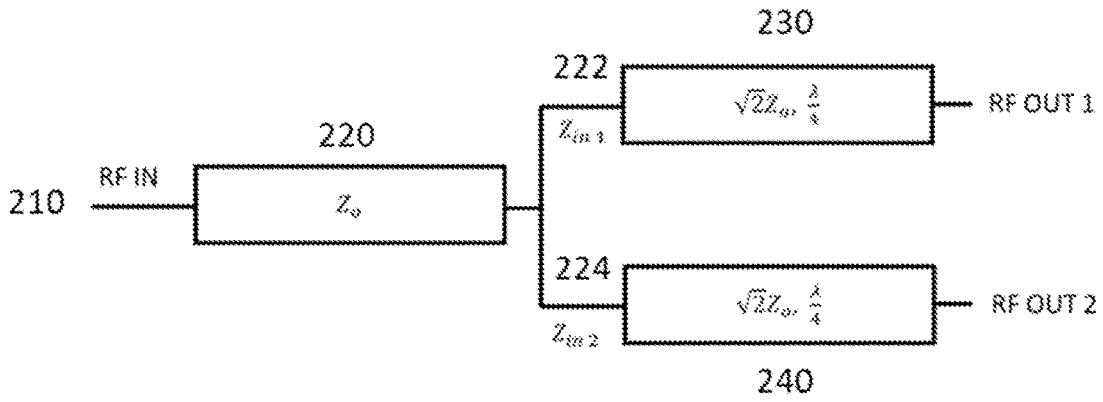
FIGS. 2A and 2B illustrate exemplary embodiments of a RF power splitter.

FIG. 2A illustrates an exemplary embodiment of a RF splitting device, which may also be called as a RF splitting apparatus and it may, in some exemplary embodiments, be understood as a circuitry. The input RF power 210 is split using two branches 230 and 240 with characteristic impedances of $\sqrt{2}Z_o$. It is assumed that the output termination 220 has an impedance of $Z_o$. In this exemplary embodiment, the input impedance of the two branches, $Z_{in\ 1}$ in 222 and $Z_{in\ 2}$ in 224 are identical and may be written as:

$$Z_{in1} = Z_{in2} = Z_{in} = \frac{2Z_O^2}{Z_O} = 2Z_O$$

Since $Z_{in\ 1}$ and $Z_{in\ 2}$ form a parallel impedance combination, the equivalent impedance presented to the input is $$\frac{2Z_O}{2} = Z_O.$$

Since the source impedance at the input is also $Z_o$, this infers that the combination presented in the exemplary embodiment of FIG. 2A does not have unwanted reflections.

Figure 2B:
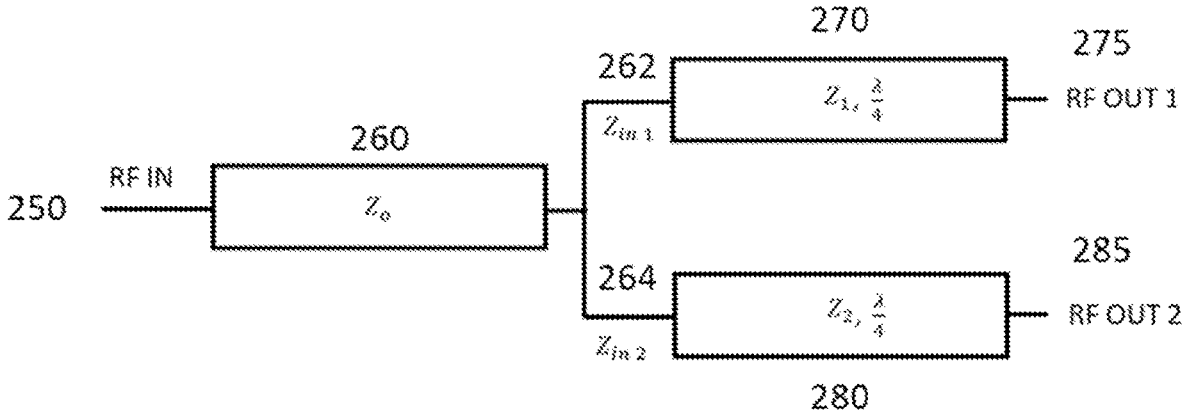

FIG. 2B illustrates another exemplary embodiment of a RF power splitter. In this exemplary embodiment, $Z_1$ and $Z_2$ represent the characteristic impedances of the coupled branches 270 and 280. In order to achieve variation in power split between the output ports 275 and 285, the characteristic impedance $Z_1$ and $Z_2$ are in this exemplary embodiment tuneable. The input impedance at the input port 250 may be written as $$Z_{in} = \frac{Z_{in1} * Z_{in2}}{Z_{in1} + Z_{in2}} = \frac{2Z_1^2 * Z_2^2}{Z_O(Z_1^2 + Z_2^2)}$$

To keep reflections low, $Z_{in}$ is in this exemplary embodiment equal to $Z_o$, and changes in $Z_2$ are accompanied with a corresponding change in $Z_1$ and vice versa. Thus, with a condition that $Z_{in}=Z_o$, one obtains $$Z_1 = \sqrt{\frac{Z_O^2 * Z_2^2}{2Z_2^2 - Z_O^2}}$$

The conditions of states variable power splitting using the structure of FIG. 2B may be achieved in a reflection-less manner provided that any change in $Z_2$ is accompanied in a corresponding impedance change.

A waveguide-based RF splitting and/or switching device, may be enhanced by adding an element, that may be understood as an electroactive element, that extends across a waveguide next to a port, which is a part of the device that is the conjunction part of a branch to the body of the device that extends outwards from the body of the device. The RF splitting and/or switching device may also be called as a RF splitting and/or switching apparatus and it may be, in some exemplary embodiments, a circuitry. The element may comprise voltage reactive material in between two electrodes. Such RF splitting and/or switching device may be operated as a waveguide based controllable RF switch with a plurality of output branches. Alternatively, or additionally, the RF splitting and/or switching device may be operated as a waveguide based controllable power divider, allowing to flexibly control the portion of power provided to a plurality of output branches. Exemplary embodiments described herein describe passive embodiments. A passive embodiment may understood as an embodiment in which the total RF output power summed up over all RF output branches/ports in maximum equals to the power of the RF input signal in case of ideal conditions with no losses and perfect matching. Yet it is to be noted that passive embodiments may be supplemented by active components such as amplifiers in order to provide increased output power levels for example.

Figure 3A:
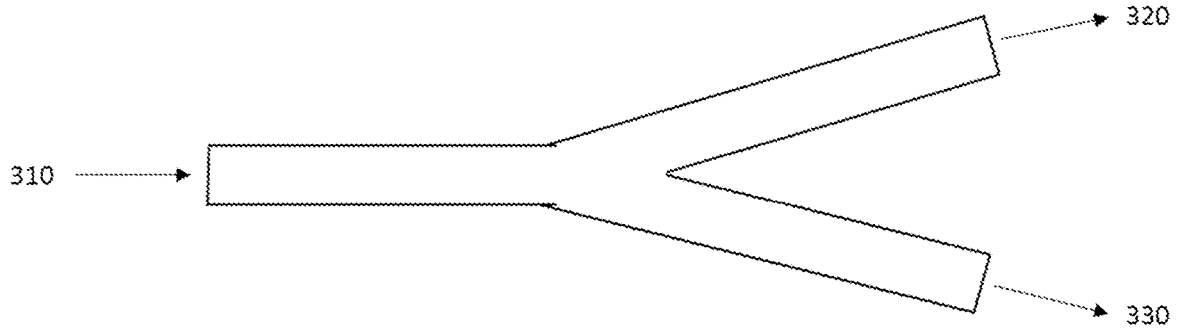
FIGS. 3A and 3B illustrate exemplary embodiments of a waveguide RF splitting device.

FIG. 3A illustrates an exemplary embodiment of a configuration of a waveguide RF splitting device. The waveguide may be for example air cavity, filled cavity or PMF. It comprises one RF input port 310 and two RF output ports that may also be understood as branches 320 and 330. It is to be noted that in some other exemplary embodiments there may be more than two outputs. The structure in this exemplary embodiment allows for power splitting but does not allow for flexible power dividing or for RF signal switching.

Figure 3B:
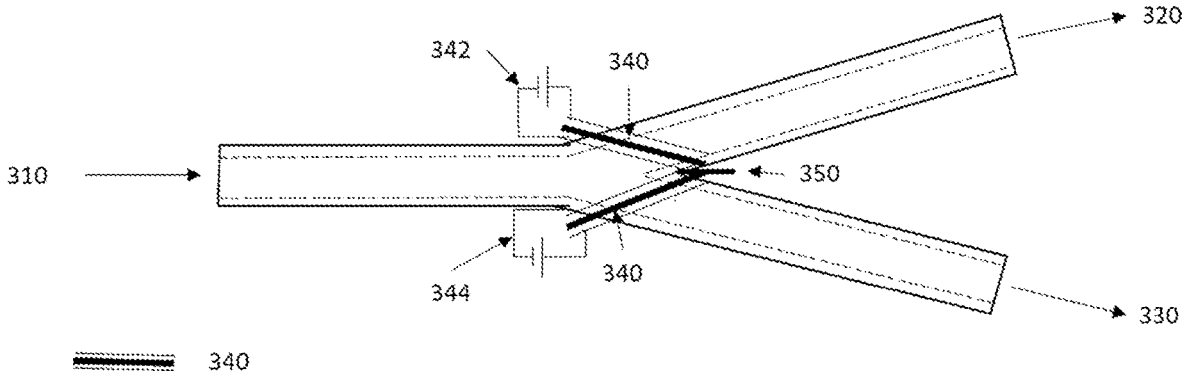

FIG. 3B illustrates an exemplary embodiment in which a waveguide RF splitting device, such as that illustrated in FIG. 3A, has been modified by adding elements 340 that comprises a voltage reactive material that is in between, i.e. sandwiched by, two electrodes. The elements 340 in this exemplary embodiment have the shape of a wall and they are placed at a port that is the beginning of a branch that extends from the body of the waveguide. The waveguide in this exemplary embodiment is a PMF waveguide. The voltage reactive material may be LC or TMO. Alternatively, the voltage reactive material may be EC walls or a combination of LC and EC or a combination of TMO and EC. The element may be controlled by applying control voltage, that may be bias voltage, 342 and 344 respectively. Thus, the elements may be individually controllable by its respective voltage control. In some alternative exemplary embodiments, voltage from one voltage control may be applied to two or more elements thereby allowing control to a plurality of elements by the same voltage control. In such exemplary embodiments, the voltage may be the same for all elements, or alternatively, there may be further control means enabling generation of different voltages to different elements independent of each other. Thus, in the exemplary embodiment of FIG. 3B a waveguide-based controllable RF splitting and/or switching device using PMF technology is achieved.

In this exemplary embodiment, the elements 340 extend the whole cross-section of the PMF core and the cladding. In some other exemplary embodiments though the elements may extend only across the PMF core cross-section but not the cladding. As mentioned above, the individual voltage control 342, 344 enable the output branches to be controlled independent of each other. This allows for flexible power splitting or switching of the RF input signal to the RF output ports 320 and 330. Yet, it is to be noted that although the two bias voltages may be flexibly controlled from each other, for ensuring adequate impedance matching between the branches, the two voltages may have to be selected in relation to each other to meet the impedance matching conditions described above for the respective power splitting to be adjusted. Further, in some exemplary embodiment there may be a sharp transition from "on" to "off" state due to which TMO may be beneficial for switching applications. LC may be beneficial for power switching as well as power splitting. In some exemplary embodiments, the bias configurations may further comprise RF blocking in order to avoid RF signal loss or any interfering signals from the biasing unit to the waveguided RF signals, which however is for sake of simplicity not illustrated in the FIG. 3B.

As described above, in this exemplary embodiment, the LC walls or TMO walls comprise an LC layer or a TMO layer sandwiched by two electrodes, being connected to the bias network. The electrodes may be realized with sub-skin thickness in order to minimize RF signal attenuation or avoid even blocking. At least one of the electrodes may be isolated from the housing in order to allow for bias voltage application by the voltage control 342, 344. In an exemplary embodiment in which the voltage reactive material is LC or TMO their respective electrodes may be isolated from each other to enable individual and independent voltage control of each element 340 that in this exemplary embodiment are walls. The walls may be individual pure LC or TMO walls that are in between electrically isolated walls. Alternatively, the walls may be understood as both LC and TMO comprised in one wall with isolated electrodes for independent control of the LC and of the TMO. Depending on the respectively applied bias voltage, the element with LC or the element with TMO may become insulating or conductive with states in between if bias voltage is selected between insulating or conductive states. Thus, an initially not controllable RF splitting device may become voltage controllable and allow for flexible control of either flexible RF signal power division to the respective output branches or acting as a RF switch either providing the RF signal to output branch1 or to output branch2.

If in another exemplary embodiment the voltage reactive material is EC instead of LC or TMO for the respective walls implemented into the PMF, a frequency tuning effect may be achieved. By applying a control voltage to the e.g. by sub-skin depth thickness electrodes sandwiched EC material, a frequency tuning effect may be achieved due to the voltage-controlled permittivity of the EC material. This permittivity and thereby frequency tuning effect may be used to attenuate an RF signal individually for each of the output branches. Additionally, or alternatively, it may be used for frequency selective applications of the RF splitting and/or switching device e.g. to provide frequency bands of a multiband RF input signal individually to the respective output branches.

Figure 3C:
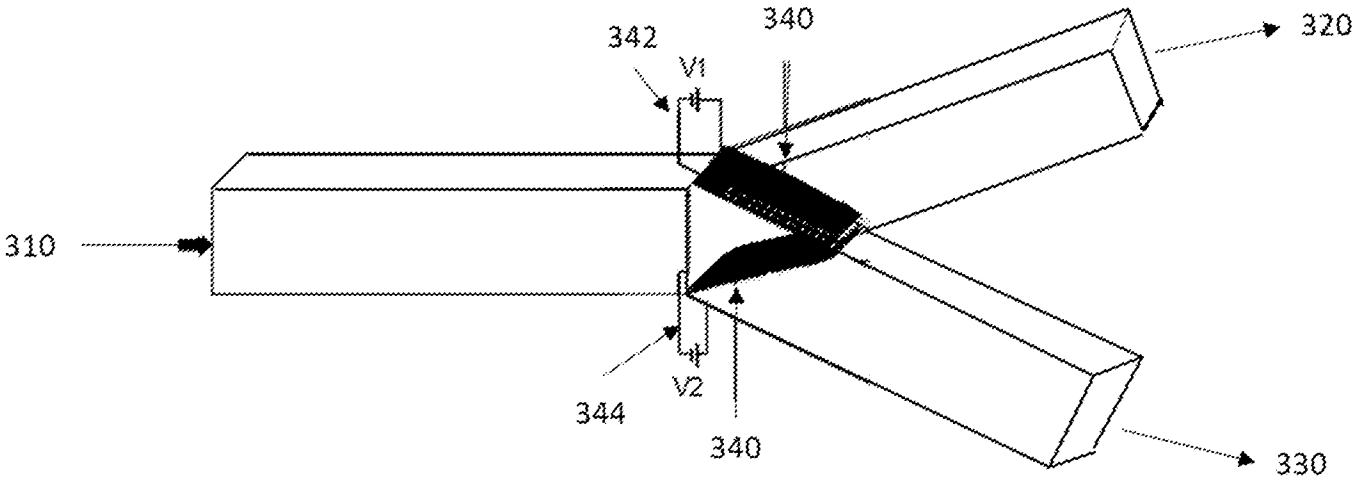
FIG. 3C illustrates an exemplary embodiment of a waveguide-based controllable RF splitting and/or switching device.

FIG. 3C is an exemplary embodiment illustrating a waveguide-based controllable RF splitting and/or switching device that has cavity waveguides. The cavity waveguides in this exemplary embodiment are air cavities. In this exemplary embodiment as in the previous ones, there are elements 340 in the ports of branches. The elements 340, that in this exemplary embodiment are walls, extend individually across the full cross-section of the individual output branches at the dividing position. Although two branches are illustrated here, there may be a plurality of branches in some other exemplary embodiments. As in the previous exemplary embodiment, using individual voltage control 342, 344 for the elements 340 the RF signal power splitting may be controlled for the output branches or an RF switch may be realized, if RF signal is blocked for one of the two output branches. While using LC or TMO as voltage reactive material a pure RF signal power splitting or switch may be obtained. If EC is used as voltage reactive material, it may additionally add possibility for frequency tuning per RF output branch resulting in a frequency band selection per output branch.

It is to be noted that in some exemplary embodiments of the voltage controllable RF splitting and/or switching device the device may comprise both, an element with TMO or LC as voltage reactive material (TMO or LC wall), and an element with EC as a voltage reactive material (EC wall), placed next to each other per branch. Different variations are possible, for example, either equipping all RF output branches a TMO or LC wall and an EC wall, each. Alternatively, only some of the RF output branches may be equipped with TMO+EC walls or LC+EC walls, while others may be equipped with a TMO wall or LC wall only or an EC wall only or all of the output branches are equipped either with a TMO wall or LC wall or with an EC wall, but no TMO+EC walls or LC+EC walls combination is used. Even further, some RF output ports may be equipped with an EC wall, some others with a TMO wall or LC wall, further ones may be equipped with TMO+EC walls or LC+EC walls and final ones may neither be equipped with a TMO wall or LC wall, nor with an EC wall, nor with TMO+EC walls or LC+EC walls.

In some exemplary embodiments, if there are a plurality of electroactive elements comprised in an element, the electroactive elements may be controlled separately. For example, by applying voltage control to the electroactive elements separately, the electroactive elements may be controlled separately of each other. The plurality of electroactive elements may be located in a same branch for example.

Figure 4A:
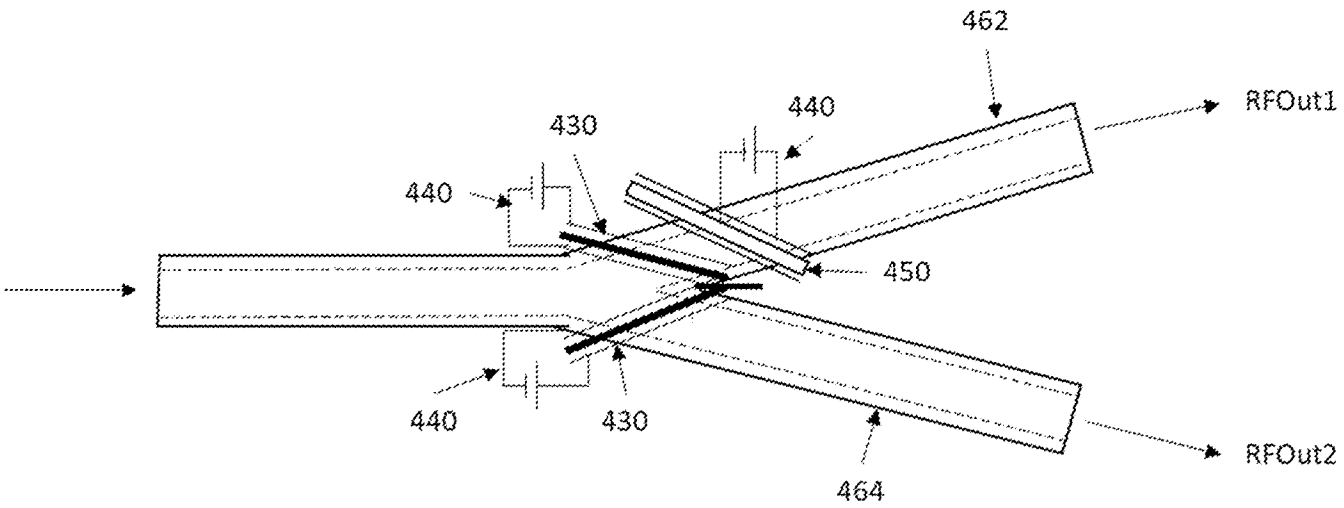
FIGS. 4A, 4B and 4C, FIG. 5 and FIG. 6 illustrate exemplary embodiments of voltage controllable RF splitting and/or switching waveguide devices.

FIG. 4A illustrates an exemplary embodiment of a voltage controllable RF splitting and/or switching PMF based waveguide device with two branches, in other words, with one input and two outputs. In this exemplary embodiment, an LC wall or a TMO wall 430 and an EC wall 450 are used both for an output branch1 462, while for output branch2/port2 464 a pure LC wall or TMO wall 430 is used. As is illustrated, the LC wall or TMO wall 430 and the EC wall 450 of the RF output branch1 462 are equipped with individual voltage controls 440. This allows for LC wall or TMO wall section 430 and EC wall section 450 independent control and thus more flexible RF splitting and/or switching device tunability. Alternatively, the LC wall or TMO wall 430 and the EC wall 450 may share a common electrode in between them. In such alternative exemplary embodiment, coordinated control voltage adaption if the inner electrode is not GND reference is to be applied. It is to be noted that the elements 430 and 450 comprise voltage reactive material in between electrodes like was described in the previous exemplary embodiments as well.

In an exemplary embodiment illustrated in FIG. 4A LC wall or TMO wall 430 and EC wall 450 implemented in output branch1 462 may allow for further frequency tuning of the characteristic of output branch1 462 such as frequency band selection. Output branch2 464, in this exemplary embodiment, only comprises a TMO wall 430 that allows for controlled injection of signal power but does not support frequency tuning. In some alternative exemplary embodiments, the device may comprise LC wall or TMO wall 430 only for output branch1 462, but LC wall or TMO wall 430 and EC wall 450 implemented in output branch2 464. In yet some other alternative exemplary embodiments, the device may comprise an LC wall or a TMO wall 430 and EC wall for both output branch1 462 and branch2 464. Further, it is to be noticed that the sequence of LC wall or TMO wall 430 and EC wall 450 may be inverse.

Figure 4B:
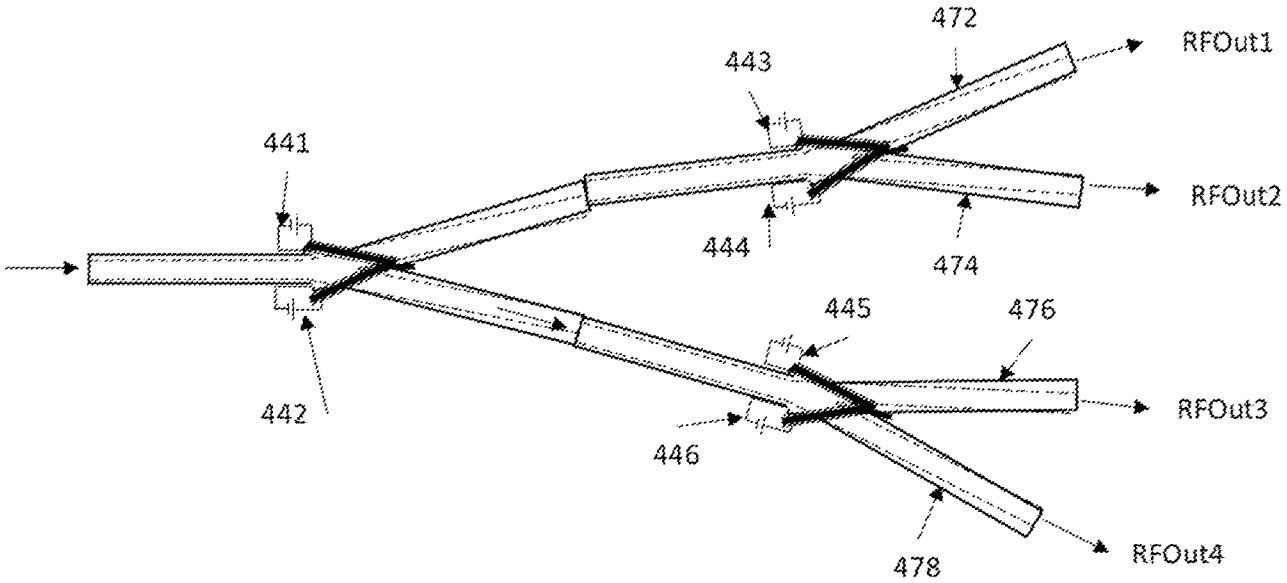

FIG. 4B illustrates an exemplarily embodiment of a voltage controllable RF splitting and/or switching waveguide device with 4 output branches, in other words, with one input and four outputs. In this exemplary embodiment, there are elements at the dividing point of each branch that are individually controlled by respective voltage controls 440. The device may be obtained by combining several of the previously described exemplary embodiment. The elements may be any combination of previously described elements, for example, pure LC walls or TMO walls, EC walls and LC walls+EC walls or TMO walls+EC walls.

An exemplary embodiment according to FIG. 4B comprises LC walls or TMO walls and thus it may not support frequency tuning. In this exemplary embodiment, RF in signal with a specific total input power is fed into the input port. Depending on the individual control voltage settings, the total power may be either provided to one of the four branches only, or by alternative control voltage settings, the power may be distributed to some branches only or to all branches, either with same output power fractions or flexibly unequally distributed for the output ports. For flexible power splitting LC material may be beneficial compared to TMO material with its sharp "on"-"off"-transition region that may be difficult to control for coordinated impedances of the output branches. The control voltages for the different possible input port to output port power transmission or frequency selection configurations may be stored e.g. in a look-up-table, LUT, for later quick recall and application during operation. For example, the look-up-table may comprise control voltages for an electroactive element for different operation conditions. Thus, for different operating conditions, such as power dividing situations or frequency switching situations, the respective required electroactive element control voltages may be quickly retrieved and control voltage be applied accordingly in order to configure the arrangement for the respective wanted operating conditions.

Table 1 below illustrates an exemplary embodiment of a voltage controllable RF splitting and/or switching waveguide device with 4 branches and its biasing and mode of operation. In this exemplary embodiment, all RF input power, that normed as 1 in this exemplary embodiment, is to be transferred to output branch3 476, RFout3. Assuming that for control voltage V=0 Van LC wall behaves like an insulator and for V=Von the LC wall becomes ideally invisible for the RF signal, the following control voltage configuration shown in Table-1 is applicable:

TABLE 1

| LC wall control voltages | | | | | | Signal power at output port | | | |
|---|---|---|---|---|---|---|---|---|---|
| V1 441 | V2 442 | V3 443 | V4 444 | V5 445 | V6 446 | RFout1 472 | RFout2 474 | RFout3 476 | RFout4 478 |
| 0 V | Von | 0 V | 0 V | Von | 0 V | 0 | 0 | 1 | 0 |

If the power of the input signal is to be equally transmitted to output branch2 474 and output branch3 476, RFout2, RFout3, the control voltage table then becomes as illustrated in Table 2 below, assuming that LC control voltage V=Von/2 allows for distributing half of the signal power:

TABLE 2

| LC wall control voltages | | | | | | Signal power at output port | | | |
|---|---|---|---|---|---|---|---|---|---|
| V1 441 | V2 442 | V3 443 | V4 444 | V5 445 | V6 446 | RFout1 472 | RFout2 474 | RFout3 476 | RFout4 478 |
| Von/2 | Von/2 | 0 V | Von | Von | 0 V | 0 | 0.5 | 0.5 | 0 |

It is to be noted that as already previously described, adding an EC wall instead of a LC wall or TMO wall or additionally to the LC wall or TMO wall, allows for additional frequency tuning and e.g. frequency selectivity for the individual output ports.

Figure 4C:
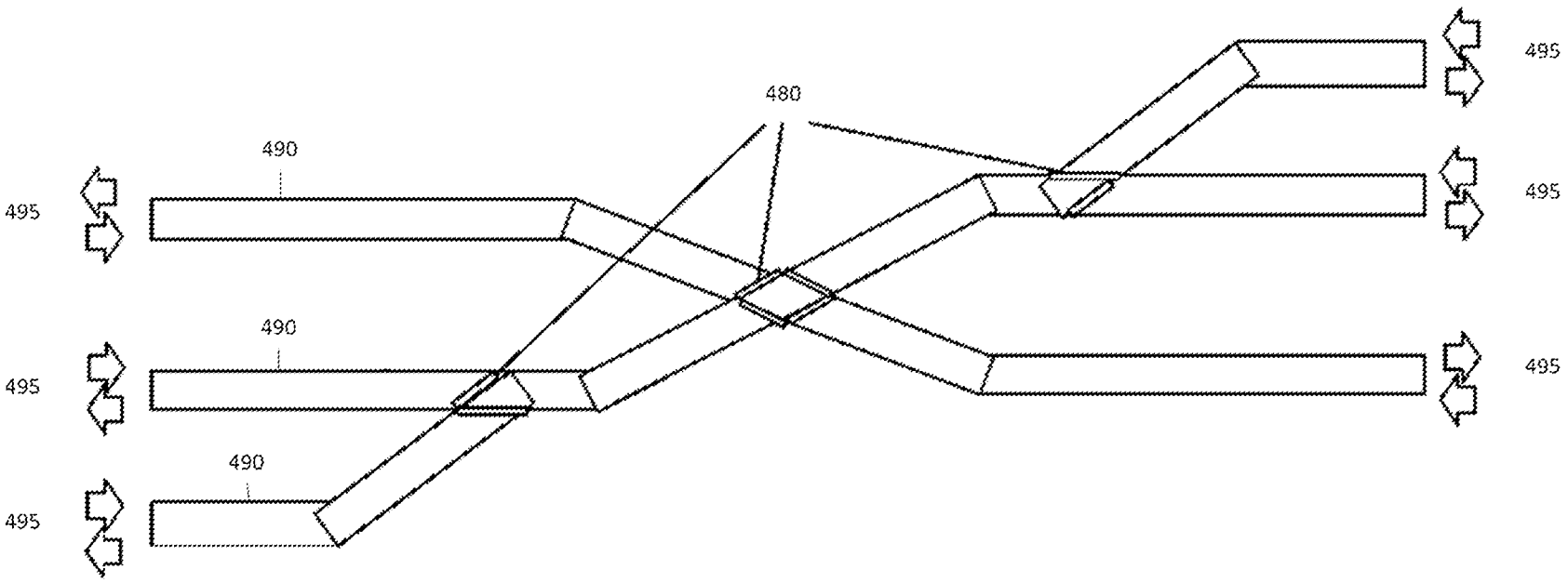

FIG. 4C illustrates a further exemplary embodiment of a voltage-controlled RF power or frequency splitting and/or switching device. In this exemplary embodiment, a waveguide 490, that may be a cavity waveguide or a PMF waveguide, comprises multiple inputs 495. In this exemplary embodiment, the inputs may also act as outputs thereby allowing bi-directional operation of the waveguide. There are also electroactive elements 480 that may be operated to achieve the splitting and/or dividing required. The electroactive elements are, in this exemplary embodiment, located at a junction of the waveguide. It is to be noted that a junction of the waveguide may also be understood as an input part of a branch. A branch may, in some exemplary embodiments, be an output for the waveguide.

In some exemplary embodiments, in which there are a plurality of inputs comprised in a waveguide, different RF signals may be provided as inputs to different inputs comprised in the waveguide. Thus, there may also be a plurality of RF signals provided to the plurality of inputs respectively.

Figure 5:
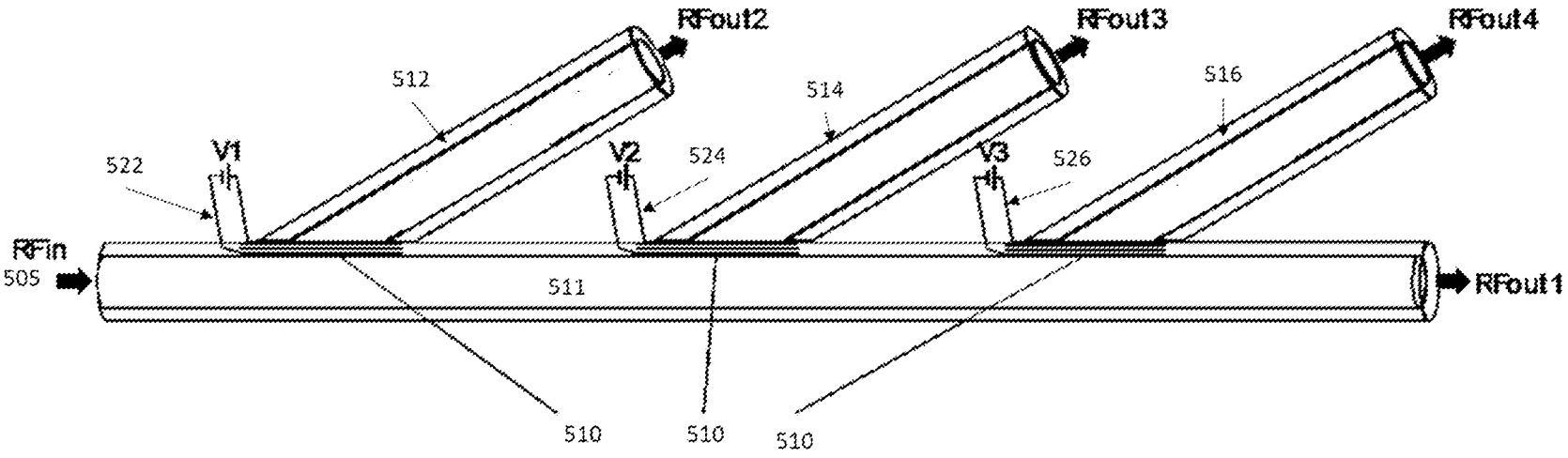

FIG. 5 illustrates an exemplary embodiment of a voltage-controlled RF splitting and/or switching waveguide with an RF input signal 505 that is to be provided to four output branches 511, 512, 514 and 516. Although there are four branches in this exemplary embodiment, in some alternative exemplary embodiments there may be another number of branches. The waveguide in this exemplary embodiment is PMF waveguide and the branches 512, 514 and 516, each comprise an element 510 that is voltage controlled. In this exemplary embodiment, the elements 510 comprise LC as voltage reactive material and the elements 510 are walls, in other words, the elements 510 may be understood as LC walls. However, TMO walls, EC walls, a mix of LC walls and EC walls or TMO walls and EC walls as well as LC-EC walls or TMO+EC walls at a branch-off may also be used. If for example a portion x of the RFin 505 input signal power is to be tapped e.g. by output branch RFout3 514 while remaining majority of the signal power is to be transmitted to branch RFout1 511, the control voltages are chosen according to Table 3 below assuming that for control voltage V=0 V the LC wall behaves like an insulator and for V=Von the LC wall becomes ideally invisible for the RF signal. The control voltage V=Vx is assumed being the control voltage for tapping RFsignal power portion x.

TABLE 3

| LC wall control voltages | | | Signal power at output port | | | |
|---|---|---|---|---|---|---|
| V1 522 | V2 524 | V3 526 | RFout1 511 | RFout2 512 | RFout3 514 | RFout4 516 |
| 0 V | Vx | 0 V | 1-x | 0 | x | 0 |

The exemplary embodiment illustrated in FIG. 4B may be utilized for example in multi-antenna systems. The exemplary embodiment illustrated in FIG. 5 may be utilized for example in bus like systems, e.g. in automotive or data centers.

Using EC in elements or adding EC material walls additionally to the LC walls or TMO walls may offer a possibility for frequency tuning and frequency selective signal tapping for the individual side-branches and further increases the field of potential applications. In general, the following three, LC, TMO and/or EC material, implementation options with individual properties may be used in a flexibly controllable RF splitting and/or switching waveguide device. The various options have the following characteristics in some exemplary embodiments:

a) Implementation of LC or TMO only
   enables RF splitting and/or switching device with controllable output power per path, but not necessarily frequency selectivity.
b) Implementation of EC material only
   enables RF splitting&switching device with controllable output power per path with additional frequency selectivity.
c) Implementation of EC material+LC or TMO
   enables RF splitting&switching device with improved controllability of output power per path paired with frequency tunability.

Figure 6:
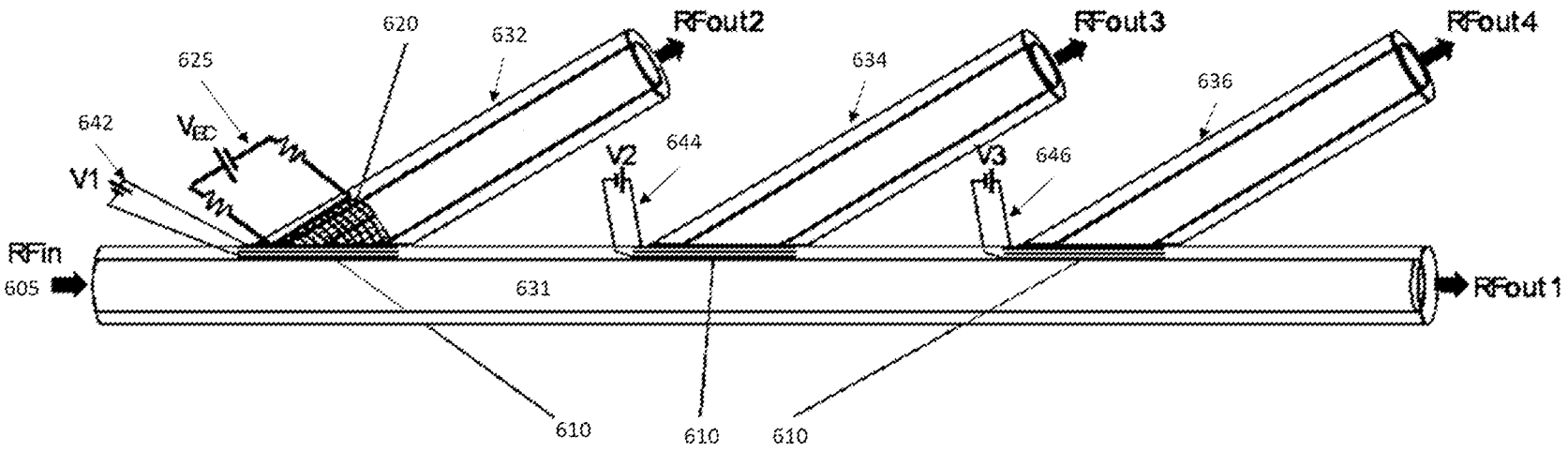

FIG. 6 illustrates a further exemplary embodiment of a voltage-controlled RF splitting and/or switching waveguide device. In this exemplary embodiment, like in the exemplary embodiments described in FIGS. 4A and 4B and FIG. 5, there is an RF input signal 605 and four output branches 631, 632, 634 and 636. Although there are four branches in this exemplary embodiment, in some alternative exemplary embodiments there may be another number of branches. The waveguide in this exemplary embodiment is PMF waveguide and the branches 632, 634 and 636, each comprise an element 610 that is voltage controlled by their respective voltage controllers 642, 644 and 646. In this exemplary embodiment, thickness of LC layer or TMO layer and number of individually controllable LC layers or TMO layers per wall 610 are chosen according to the respective applications. As for the LC walls or TMO walls, EC layer thickness may also be a further design parameter, as well as number of individually voltage-controlled EC segments per EC wall. By e.g. segmenting the EC wall into individually controllable EC segments, an improved frequency selection characteristic may be achieved, being additionally affected by the spacing between the individually voltage-controlled EC segments. Further, instead of implementing the element that comprises EC material as voltage-controlled material in between electrodes, as a wall extending across the waveguide, that in this exemplary embodiment is a PMF waveguide, the element may also be implemented as a ring 620. If the ring 620 is the implemented shape, the EC material may still be in between electrodes. The ring 620 extends around the PMF core. Such rings may be used either solely at the branch-off positions or in combination with the discussed LC walls or TMO walls. An exemplarily embodiment having implemented an EC ring wrapping the PMF core of the side-branch at the branching-off position of RFout2 is illustrated in FIG. 6. In some exemplary embodiments there may be an EC ring and an EC wall both implemented for one branch for example as a combination with TMO and/or LC. In this exemplary embodiment, the ring 620 may be controlled by its respective voltage controller 625.

It is to be noted that in general in exemplary embodiments in which one or more LC, TMO and/or EC are used, the thickness of LC layer or TMO layer and number of individually controllable LC layers or TMO layers per wall may be chosen according to target applications in which the layers are to be utilized. Also, as described above as well, as for the LC walls or TMO walls, EC layer thickness may also be a further design parameter, as well as number of individually voltage-controlled EC segments per EC wall. By e.g. segmenting the EC wall into individually controllable EC segments, an improved frequency selection characteristic may be achieved, being additionally affected by the spacing between the individually voltage-controlled EC segments. In general, the thickness of an electroactive material is to be chosen according to the intended usage such that signals are blocked when blocking is required and on the other hand, low loss signal passing is allowed when pass-through mode is required.

Figure 7A:
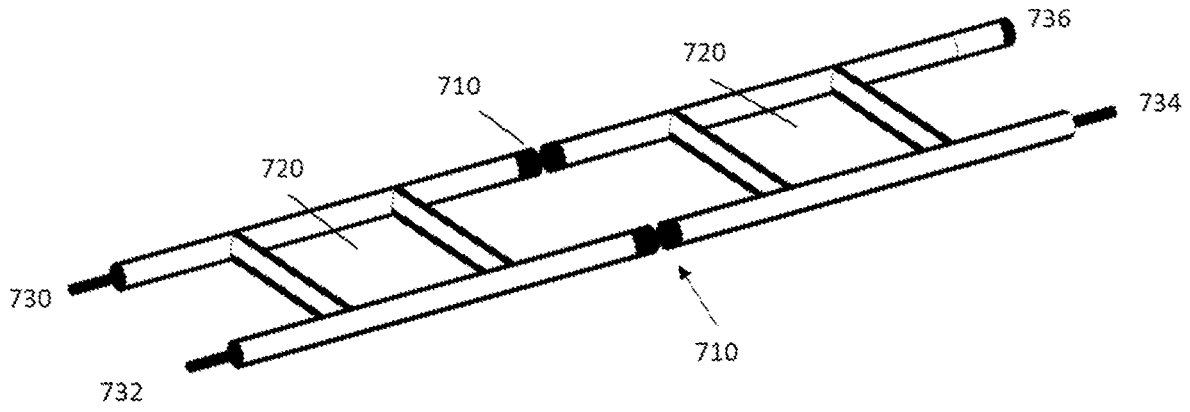
FIGS. 7A, 7B and 7C illustrate exemplary embodiments of a structure of a reflective-type RF power switching and splitting device.
Figure 7B:
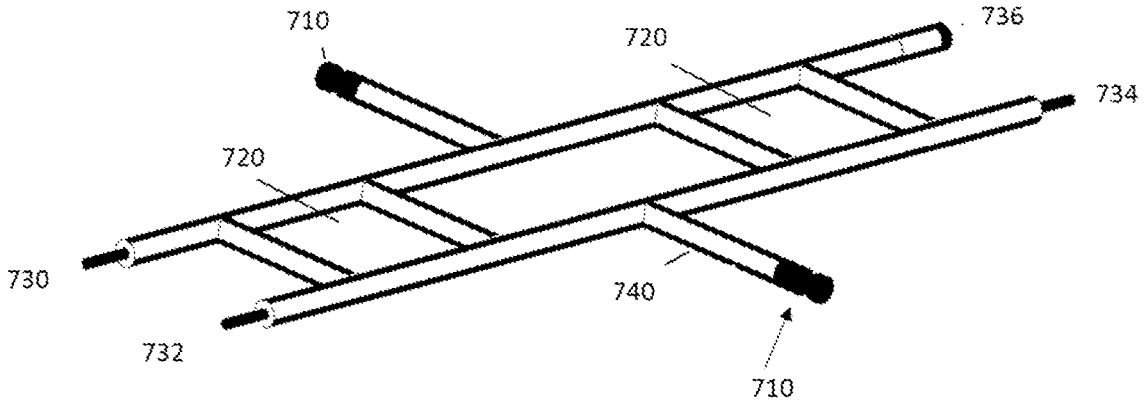

The exemplary embodiments discussed above relate to transmission-type RF power switching and splitting waveguide devices. Yet, reflective-type embodiments of RF power switching and splitting devices in reflective-type embodiments are cogitable. FIGS. 7A and 7B illustrate exemplary embodiments of a structure of a reflective-type RF power switching and splitting device that may be a circuitry and/or may be voltage controlled. In reflective-type devices that are implemented in the waveguide form variable impedance elements 710 may be in the form of TMO/EC and LC. The structure illustrated in FIGS. 7A and 7B is reflection-less, i.e. regardless of the kind of signal processing performed on the input signal 730, there are no detrimental reflections at any port. This is ensured by the 3-dB couplers 720 in the back-to-back configuration.

Figure 7C:
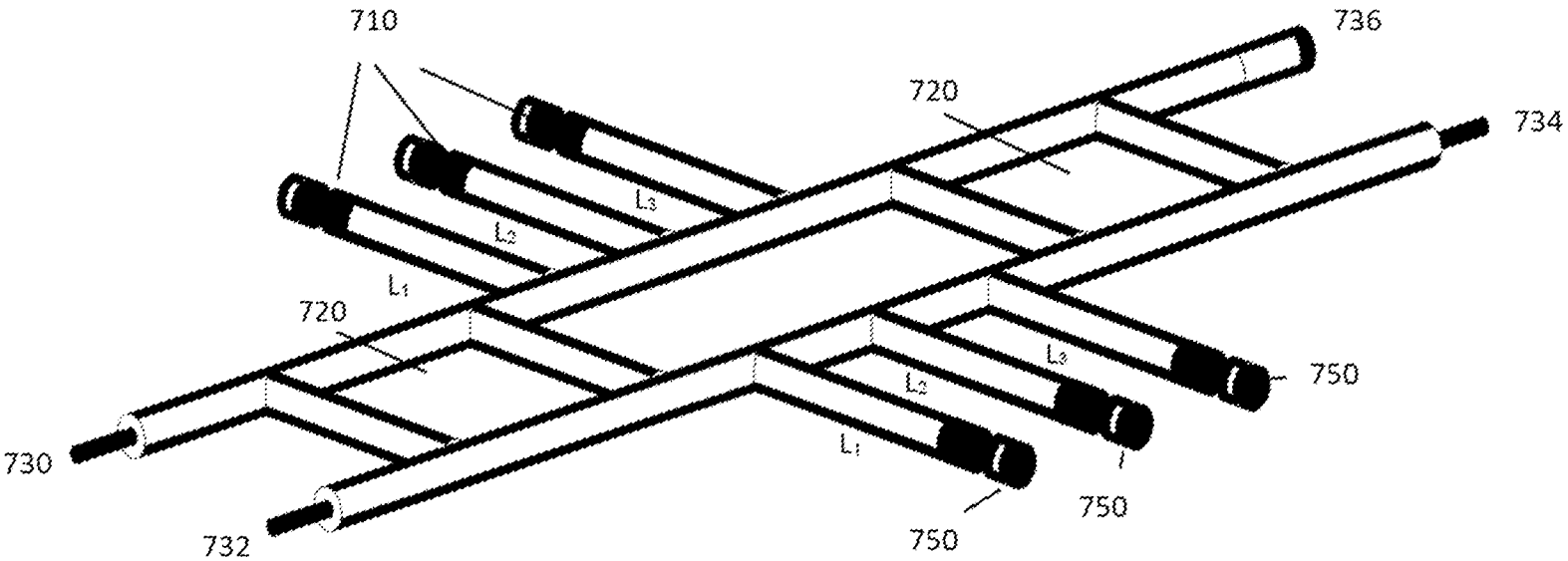

The active material needs to be either able to vary its capacitance or resistance. Continuous variation of capacitance may be achieved with a range of materials, of which EC and LC are examples. By varying the capacitance in either series, as illustrated in FIG. 7A, or parallel, as illustrated in FIG. 7B, configurations, the available power at the input may be dynamically split between the two output ports 732 and 734. The variation of resistance, however, is to be able to switch from LOW resistance state to the HIGH resistance state. A resistance state between these two states may incur losses to the devices and, thus, is beneficial to be avoided. This, however, may limit the tunability of the device, since all input power will either be channeled to Output1 732 or Output2 734. Illustrated in FIGS. 7A and 7B there is also a termination 736. In 7B also the length 740 is illustrated. The length 740 may be part of the parallel configuration of the active material, such as EC, LC or TMO, to enable controlling of the parallel based power splitter configuration. The length 740 may be aligned to provide suitable transformation of the active material to the coupler ports. However, on the other hand, fixed division power ratios may have better intermodulation performance compared to their continuous tuning counterparts. For this purpose, it may be possible to have a device similar to the one in FIGS. 7A and 7B, employing multiple shunt arms, terminated in a TMO based switch and either fixed or tunable capacitors. One such exemplary embodiment is depicted in FIG. 7C, showing a device with 3 shunt arms, in which each arm is terminated in a switch containing a capacitor formed using a layer of PMF material and electrically thick conductor, in other words, an element 710. At least some, or each, pair of arms may be switched independently, and more than one arm may be switched ON/OFF at the same time. In this way, the device of FIG. 7C may have $2^3=8$ power division states. The number of states may be increased by increasing the amount of shunt arms, i.e. $2^n$. The length of each pair of arms may be used as a design parameter so as to achieve the required division ratio for each state. If needed, it may be possible to make the capacitors, C1, C2 and C3 tunable by the use of either EC materials or Liquid Crystals (LC). In this way, for a low number of shunt arms, switching specific arms ON/OFF may perform the function of coarse tuning, while the continuously tunable capacitors may cater for fine tuning.

Figure 7D:
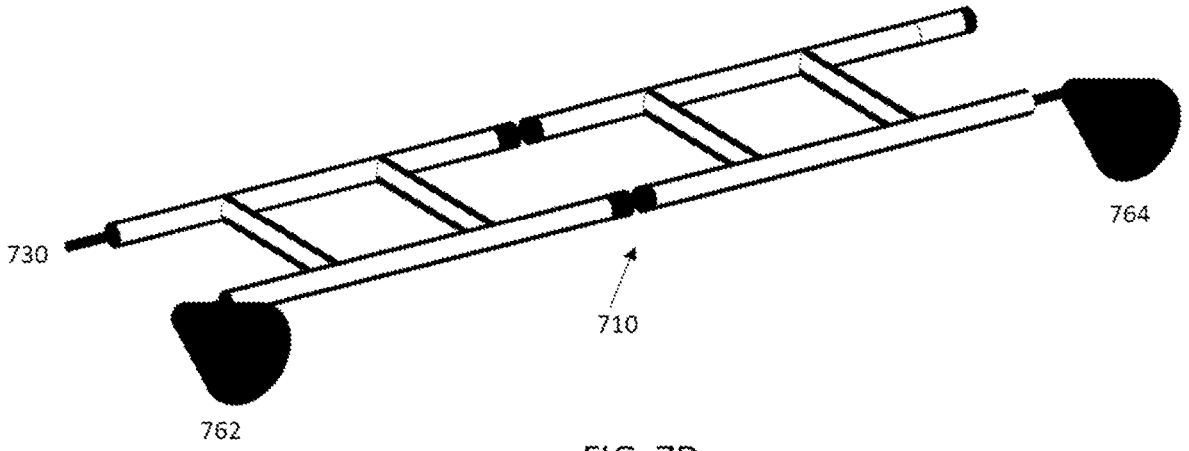
FIG. 7D-7G illustrate exemplary embodiments devices utilizing structures of FIG. 7A-7C.
Figure 7E:
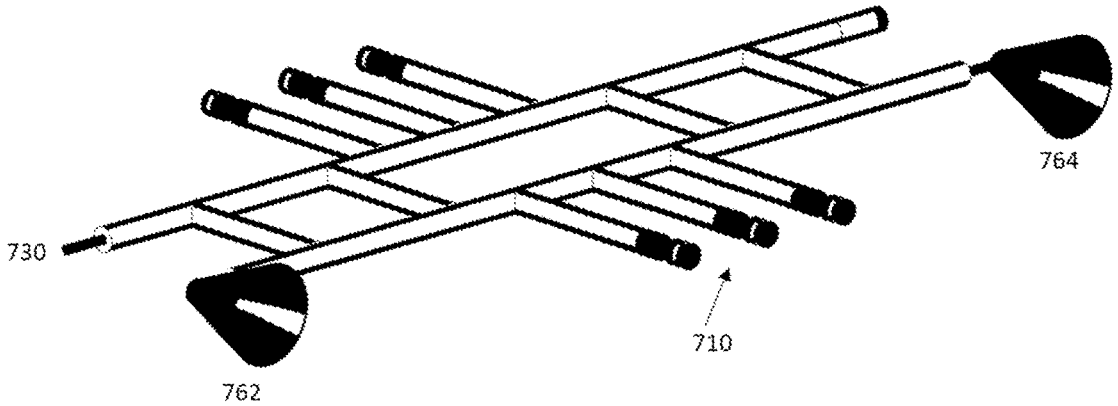

Exemplary embodiments of devices in which the structures described above may be used are illustrated in FIG. 7D-7G. In the devices of FIG. 7D and FIG. 7E, input power 730 may be variably split between two antennas 762 and 764, depending on the requirements of the application. The phase difference between the output ports in all devices illustrated in the exemplary embodiments may be constant and equal to 90 degrees. In the exemplary embodiment of FIG. 7D, a serial implementation of electroactive elements, such as EC, LC and/or TMO, is used. FIG. 7E illustrates an exemplary embodiment comprising an array of the two antennas 762, and 764. In this exemplary embodiment, there are electroactive elements, such as EC, LC and/or TMO, that each are implemented in a parallel configuration and in a distributed manner of three arm parallel switched capacitor configurations.

Figure 7F:
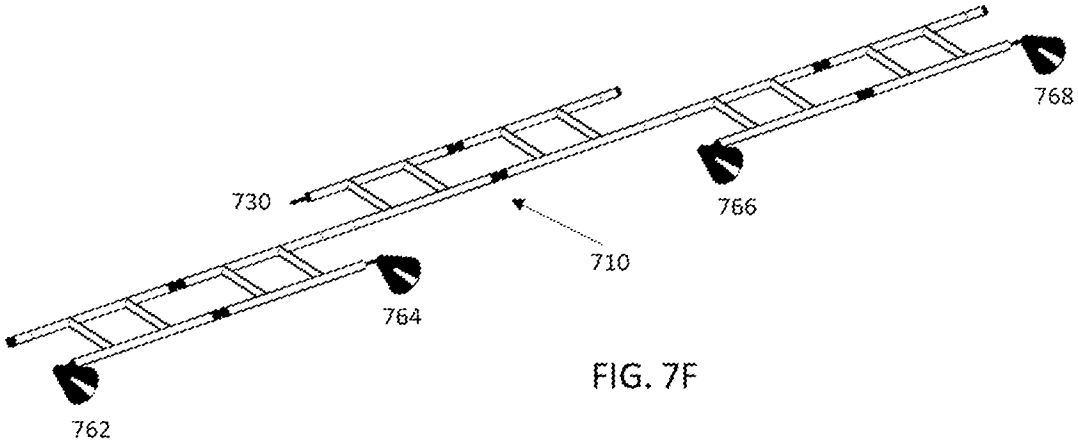
Figure 7G:
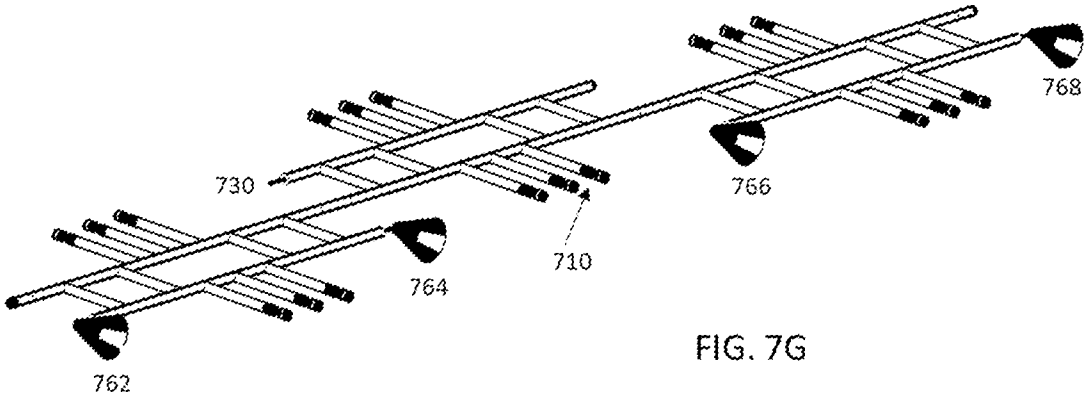

FIGS. 7F and 7G illustrate further exemplary embodiments of an implementation by having four output ports and thereby antennas instead of two as illustrated in FIGS. 7D and 7E. In FIG. 7F electroactive elements, such as EC, LC and/or TMO, that are configured serially, are illustrated. In FIG. 7G electroactive elements that are configured in a parallel manner are illustrated.

Figure 7H:
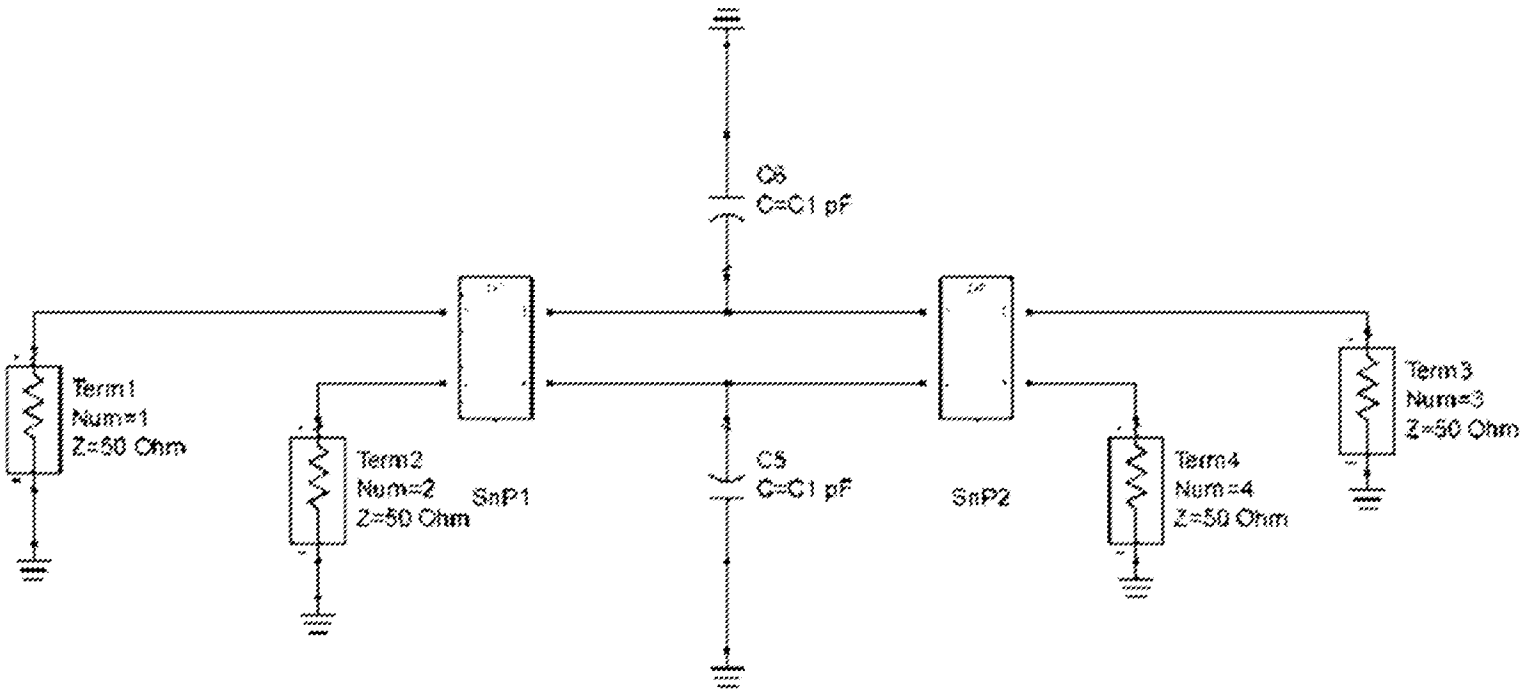
FIG. 7H illustrates an exemplary embodiment of a power splitter.
Figure 7J:
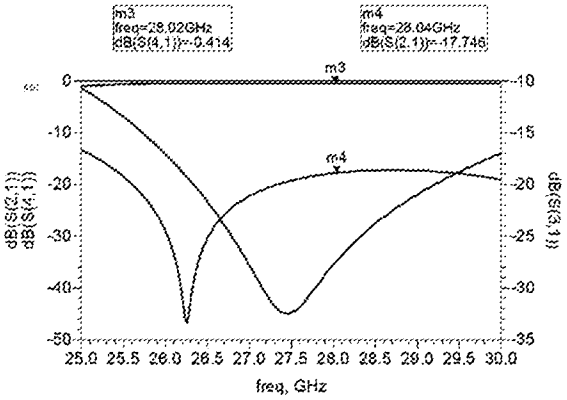
FIG. 7I-7K illustrate performance results of power splitting.
Figure 7I:
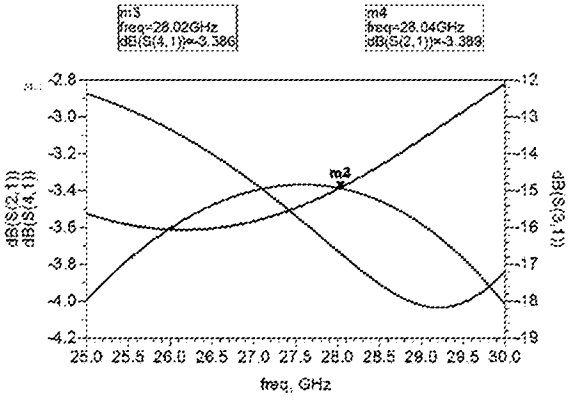

FIG. 7H illustrates a power splitter according to an exemplary embodiment. In this exemplary embodiment, the power splitter is a 3-dB coupler operating at 28 GHz. Its insertion loss is 0.3 dB, while its +/−0.5 dB bandwidth is 3 GHz. The schematic of the power splitter is illustrated in FIG. 7H, together with port designations. FIG. 7I illustrates performance of the splitter according to the exemplary embodiment when equal power division is expected. FIGS.

Figure 7K:
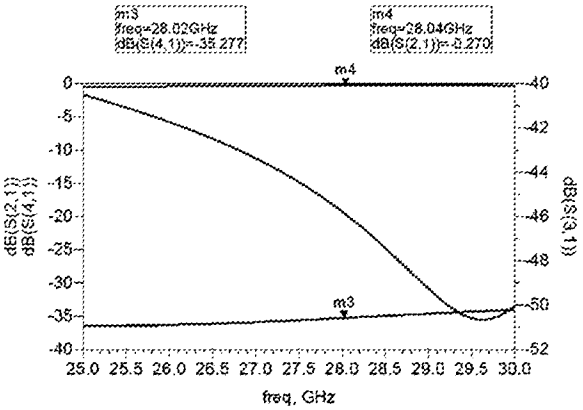

7J and 7K illustrate the power splitting performance when input power is directed to ports 4 and 2, respectively. As can be seen, the dynamic range for the case depicted in FIG. 7J is about 17 dB and over 30 dB for the case depicted in FIG. 7K.

It is to be noted that an apparatus comprising a waveguide, such as those described in the exemplary embodiments above, may be a passive device and may be combined with other passive devices and/or active devices such as amplifiers. Further, if the apparatus is of transmission type, voltage reactive material may be placed at a dividing part of two branches. If the apparatus is a of reflective type and has a parallel implementation of electroactive elements, then voltage reactive material may be placed at the end of reflective load stubs or lines, which have a suitable transformation length and may also be considered as branches. If the apparatus is of reflective type and has an implementation with serial load paths, that may also be considered as branches, electroactive elements may be placed in the serial load paths with a suitable line transformation distance. It is further to be noted that in some exemplary embodiments, the apparatus may be of reflective-type implementation and the electroactive elements may be placed directly at the edges of a structure in which reflective load branches are attached. Thus, in such exemplary embodiments, transformation line length is, at least substantially, zero.

Figure 8:
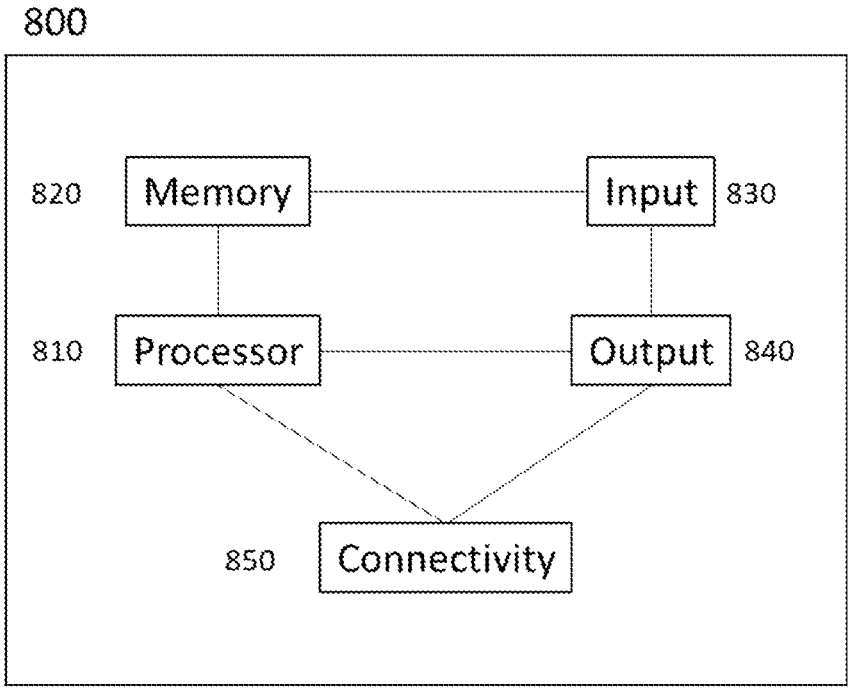
FIG. 8 illustrates an exemplary embodiment of an apparatus.

FIG. 8 illustrates an apparatus 800, which may comprise or be connected to a voltage controlled power splitting and/or switching device waveguide according to an example embodiment. The apparatus 800 comprises a processor 810. The processor 810 interprets computer program instructions and processes data. The processor 810 may comprise one or more programmable processors. The processor 810 may comprise programmable hardware with embedded firmware and may, alternatively or additionally, comprise one or more application specific integrated circuits, ASICs.

The processor 810 is coupled to a memory 820. The processor is configured to read and write data to and from the memory 820. The memory 820 may comprise one or more memory units. The memory units may be volatile or non-volatile. It is to be noted that in some example embodiments there may be one or more units of non-volatile memory and one or more units of volatile memory or, alternatively, one or more units of non-volatile memory, or, alternatively, one or more units of volatile memory. Volatile memory may be for example RAM, DRAM or SDRAM. Non-volatile memory may be for example ROM, PROM, EEPROM, flash memory, optical storage or magnetic storage. In general, memories may be referred to as non-transitory computer readable media. The memory 820 stores computer readable instructions that are execute by the processor 810. For example, non-volatile memory stores the computer readable instructions and the processor 810 executes the instructions using volatile memory for temporary storage of data and/or instructions.

The computer readable instructions may have been pre-stored to the memory 820 or, alternatively or additionally, they may be received, by the apparatus, via electromagnetic carrier signal and/or may be copied from a physical entity such as computer program product. Execution of the computer readable instructions causes the apparatus 800 to perform functionality described above.

In the context of this document, a "memory" or "computer-readable media" may be any non-transitory media or means that can contain, store, communicate, propagate or transport the instructions for use by or in connection with an instruction execution system, apparatus, or device, such as a computer.

The apparatus 800 further comprises, or is connected to, an input unit 830. The input unit 830 comprises one or more interfaces for receiving a user input. The one or more interfaces may comprise for example one or more motion and/or orientation sensors, one or more cameras, one or more accelerometers, one or more microphones, one or more buttons and one or more touch detection units. Further, the input unit 830 may comprise an interface to which external devices may connect to.

The apparatus 800 also comprises an output unit 840. The output unit comprises or is connected to one or more displays capable of rendering visual content such as a light emitting diode, LED, display and a liquid crystal display, LCD. The output unit 840 further comprises one or more audio outputs. The one or more audio outputs may be for example loudspeakers or a set of headphones.

The apparatus 800 may further comprise a connectivity unit 850. The connectivity unit 850 enables wired and/or wireless connectivity to external networks. The connectivity unit 850 may comprise one or more antennas and one or more receivers that may be integrated to the apparatus 800 or the apparatus 800 may be connected to. The connectivity unit 850 may comprise an integrated circuit or a set of integrated circuits that provide the wireless communication capability for the apparatus 800. Alternatively, the wireless connectivity may be a hardwired application specific integrated circuit, ASIC.

It is to be noted that the apparatus 800 may further comprise various component not illustrated in the FIG. 8. The various components may be hardware component and/or software components.

Even though the invention has been described above with reference to an example according to the accompanying drawings, it is clear that the invention is not restricted thereto but can be modified in several ways within the scope of the appended claims. Therefore, all words and expressions should be interpreted broadly and they are intended to illustrate, not to restrict, the embodiment. It will be obvious to a person skilled in the art that, as technology advances, the inventive concept can be implemented in various ways. Further, it is clear to a person skilled in the art that the described embodiments may, but are not required to, be combined with other embodiments in various ways.

The invention claimed is:

1. An apparatus that is a voltage-controlled splitting and/or switching apparatus comprising:

a waveguide for a radio frequency signal comprising at least one input and at least two outputs, wherein the waveguide is a cavity waveguide or a polymer microwave fiber waveguide, and the waveguide comprises at least a first branch and a second branch;

at least one element comprising voltage reactive material in between electrodes and extending, at least partly, across at least one of the first branch and the second branch; and a voltage control caused to apply voltage to the at least one element wherein the at least one element comprises a plurality of layers of voltage reactive material, and wherein at least one layer of the plurality of layers comprises electrochromic material and at least one layer of the plurality of layers comprises liquid crystal or transition metal oxide.

2. An apparatus according to claim 1, wherein the at least one element is located at an input part of the at least one of the first and the second branch or at an end of at least one of the first branch and the second branch.

3. An apparatus according to claim 1, wherein the at least one element is a wall extending, at least partly, across the cross-section of the respective branch or a ring extending around the respective branch.

4. An apparatus according to claim 1, wherein the at least one element is coupled to another element at a dividing part and wherein the other element comprises at least one of electrochromic material, liquid crystal and/or transition metal oxide, as the voltage reactive material.

5. An apparatus according to claim 1, wherein the apparatus is a voltage-controlled radio frequency splitting and/or switching device or the apparatus is a voltage-controlled power splitting and/or switching device.

6. An apparatus according to claim 1, wherein the apparatus is transmission-type or reflective-type.

7. A method comprising:

providing a radio frequency signal to at least one input of a waveguide for a radio frequency signal, that is comprised in a voltage-controlled splitting and/or switching apparatus, and wherein the waveguide comprises the at least one input and at least two outputs, wherein the waveguide is a cavity waveguide or a polymer microwave fiber waveguide and comprises at least a first branch and a second branch, the apparatus further comprising at least one element comprising voltage reactive material in between electrodes and extending, at least partly, across at least one of the first branch and the second branch the apparatus further comprising a voltage control; and causing at least one voltage control to apply voltage to the at least one element, wherein the at least one element comprises a plurality of layers of voltage reactive material and at least one layer of the plurality of layers comprises electrochromic material and at least one layer of the plurality of layers comprises liquid crystal or transition metal oxide.

8. A method according to claim 7, wherein the voltage is applied such that the radio frequency signal is switched and/or power divided by the waveguide.

9. A method according to claim 7, wherein the voltage applied by the voltage control is applied according to information retrieved from a look-up table.

10. A method according to claim 7, wherein the voltage is applied to sub-skin depth electrodes.

11. A method according to claim 8, wherein the waveguide comprises a plurality of elements and the method further comprises applying voltage control separately to the plurality of elements.

12. A method according to claim 7, wherein the waveguide comprises a plurality of inputs and the method further comprises providing a plurality of radio frequency signals to the plurality of inputs respectively.

13. A non-transitory computer readable medium comprising instructions stored thereon to perform at least the following:

providing a radio frequency signal to at least one input of a waveguide for a radio frequency signal, that is comprised in a voltage-controlled power and/or radio frequency splitting and/or switching apparatus, and wherein the waveguide comprises the at least one input and at least two outputs, wherein the waveguide is a cavity waveguide or a polymer microwave fiber waveguide and comprises at least a first branch and a second branch, the apparatus further comprising at least one element comprising voltage reactive material in between electrodes and extending, at least partly, across at least one of the first branch and the second branch and the apparatus further comprising a voltage control; and causing at least one voltage control to apply voltage to the at least one element, wherein the at least one element comprises a plurality of layers of voltage reactive material and at least one layer of the plurality of layers comprises electrochromic material and at least one layer of the plurality of layers comprises liquid crystal or transition metal oxide.

* * * * *